United States Patent [19]

Miller

[11] 4,178,833

[45] Dec. 18, 1979

[54] SNAP RING BEARING FOR A GUN BARREL BUSHING

[76] Inventor: Fred R. Miller, 2620 E. 32nd St., Davenport, Iowa 52807

[21] Appl. No.: 733,658

[22] Filed: Oct. 18, 1976

[51] Int. Cl.[2] ..... F41C 5/06

[52] U.S. Cl. ..... 89/163

[58] Field of Search ..... 89/163, 196

[56] References Cited

U.S. PATENT DOCUMENTS

| | | | |
|---|---|---|---|
| 3,158,064 | 11/1964 | Charron | 89/163 |
| 3,411,408 | 11/1968 | Pachmayr et al. | 89/196 |
| 3,564,967 | 2/1971 | LaViolette et al. | 89/163 |
| 3,901,125 | 8/1975 | Raville | 89/163 |

*Primary Examiner*—Stephen C. Bentley

*Attorney, Agent, or Firm*—Nathan Edelberg; Robert O. Richardson

[57] ABSTRACT

A spring steel snap ring bearing between the gun barrel and the barrel bushing to remove the relative play therebetween and thus accurately position the barrel relative to the sights on the slide to improve its aiming characteristics. This relative play between the barrel and barrel bushing on the slide is incorporated in its manufacture to permit pivotal as well as longitudinal movement of the barrel relative to the slide containing the bushing.

5 Claims, 4 Drawing Figures

SNAP RING BEARING FOR A GUN BARREL BUSHING

Government Rights

The invention described herein may be manufactured and/or used by or for the Government for governmental purposes without the payment of any royalty thereon.

BACKGROUND OF THE INVENTION

The M1911 cal. .45 ACP (Automatic Colt Pistol), invented by John M. Browning, was adopted in 1911 as the standard U.S. Service pistol. Since its development there have been no modifications to the standard issue service pistol that increases its accuracy capability. The standard issue service pistol has an accuracy capability of shooting a group of shots in a ten-inch circle at fifty yards. For accurate shooting this leaves much to be desired. Part of this inaccuracy is caused by the barrel within the barrel bushing not being in the same position after each shot. The barrel is therefore in a different position relative to the sights on the slide after each shot. This is caused by the loose tolerance between the barrel and barrel bushing. This loose tolerance characteristic has not been changed in standard production for fear of causing functioning problems which would yield an unreliable weapon in combat.

To improve this condition many methods have been tried with varying degrees of success. An early method was to punch or indent the barrel bushing around its circumference in an effort to tighten the bushing to the barrel. This is successful for a short period of time until the indentations wore off.

Another early method was to braze a bearing metal to the inside of the bushing to reduce the tolerance. It was effective but didn't hold up for very long.

The barrel bushings were manufactured with an undersize internal diameter which could be fitted to the specific barrel. This method works well in reducing the tolerance, but the cost of the bushing and machine work is too expensive.

As each method was tried, new developments came about. It was found that by reducing the barrel diameter ½" from the end of the muzzle 0.004"–0.005" (four to five thousandths), then fitting a special bushing with the undersize internal diameter, a greater degree of position lock up could be achieved which improved accuracy considerably. This method is still in use and works well to improve accuracy. It requires a considerable amount of machine work in turning down the diameter of the barrel, boring out the bushing and inserting another bushing which has the inside diameter matching the outside diameter of the barrel. This insert is silver soldered inside the bored out barrel bushing. This is a satisfactory method of reducing the tolerance between the barrel and the barrel bushing to afford a positive resting position of the barrel every time the weapon is fired. However, this substantial modification is time consuming, costly and requires skillful workmanship.

A recent development which aids accuracy to a minor degree is accomplished by manufacturing a barrel bushing which has spring steel properties. The bushing is split into four sections appearing like fingers which press in on the barrel. This reduces the barrel end play and adds to the accuracy capability. A problem arises as the barrel heats. Heat is transferred to the barrel bushing which changes the spring characteristics of the finger projections. This allows excessive movement of the barrel which defeats the purpose of the special barrel bushing.

When match barrels are manufactured, they are made oversize so they may be hand fitted to the specific barrel bushing and slide. The increased barrel diameter is manufactured into the barrel end, whereas before it was achieved through relieving the diameter 0.004"–0.005" (four to five thousandths) and decreasing the internal diameter of the bushing as previously described.

SUMMARY OF THE INVENTION

The present invention is intended to make a service Colt. .45 automatic pistol and similar pistols with sights on a slide more accurate and at the same time retain a high degree of reliability under adverse field conditions.

Briefly, the .45 automatic pistol has a slide which moves longitudinally over the barrel. This slide has both front and rear sights mounted on it and, of course, they also move relative to the barrel. In addition, the barrel has a pivotal movement which locks and unlocks the slide in the firing operation. A barrel bushing in the slide is mounted over the barrel to position the barrel relative to the slide. There is of necessity a loose fit between the barrel and bushing to accommodate the pivotal movement of the barrel in the slide lockup operation.

In accordance with the present invention, a spring steel ring type bearing may be slipped over the muzzle end of the barrel. A groove approximately 3/16" (three-sixteenths) from the muzzle end and about 0.025" (twenty-five thousandths) deep is provided in the barrel, into which the ring bearing is seated. The ring bearing is split and is approximately 0.032" (thirty-two thousandths) thick with a rounded outside shoulder, i.e., the outer surface of the ring is convexly curved across its width. The ring will sufficiently reduce the tolerance between the barrel and the barrel bushing to accurately position the barrel in the battery or firing position. Accuracy is therefore enhanced since the position of the barrel relative to the sights on the slide is exactly the same after each shot.

Functionability is not affected in that the binding pressure between the ring and the barrel bushing is decreased as the barrel unlocks out of battery and the barrel pivots relative to the slide. This approach involves the least amount of machining and affords economical part replacement since the ring bearings are very inexpensive. Also, as it becomes necessary to replace the ring bearings, a larger diameter ring may be substituted to compensate for wear on the inside surface of the barrel bushing.

DETAILED DESCRIPTION OF PREFERRED EMBODIMENT

Figure 1:
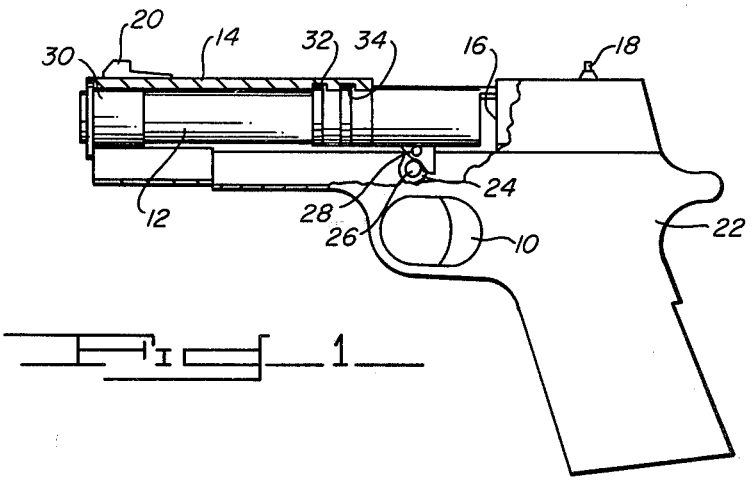
FIG. 1 is a side elevational view of a .45 caliber automatic pistol with portions removed to show the barrel and slide lock-up.

Reference is now made to FIG. 1 which shows an automatic pistol of the type utilizing the present invention. One such pistol is designated the M1911 Service Pistol which was adopted in 1911 as the standard U.S. Service pistol. After rigorous tests to determine its combat serviceability under every condition likely to be encountered in the field, and afte service in two World Wars, the Korean War and a host of small campaigns, it is unchallenged as the finest military pistol ever developed. This pistol was made by several commercial firms and the parts are generally interchangeable regardless of manufacturer. To insure proper functioning under adverse field conditions, certain clearances were deliberately incorporated in the mechanism of this pistol.

The operation of the pistol above mentioned is so well known that only those parts and their operation which require the structure of the present invention and an understanding of its operation will be described herein. Briefly, in FIG. 1 the gun is in battery position and ready for firing. When trigger 10 is squeezed, the projectile is fired out barrel 12. This barrel fits within a slide 14 and bears against a back portion 16 of the slide. Back pressure from the fired cartridge forces this slide rearwardly to the recoil position shown in FIG. 2. The slide 14 has a rear sight 18 and a front sight 20. The barrel 12 is supported on pistol frame 22 through a link 24 pivotally mounted at 26 to the frame and pivotally mounted at 28 to the barrel. The muzzle end of barrel 12 fits within a barrel bushing 30 which nests snuggly within the front part of slide 14. Lugs 32 on the barrel fit within grooves 34 on the slide to prevent relative motion between the two until after the gun has been fired.

The connection of the lugs 32, grooves 34 and the linkage 24 maintain the rear portion of the barrel 12 firmly relative to the front sight and rear sights 18 and 20. The inaccuracy of the weapon then is attributed to the loose fitting between the front end of the barrel 12 and the barrel bushing 30. Thus, the barrel 12 does not always point to the target that the sights 18 and 20 indicate.

Figure 2:
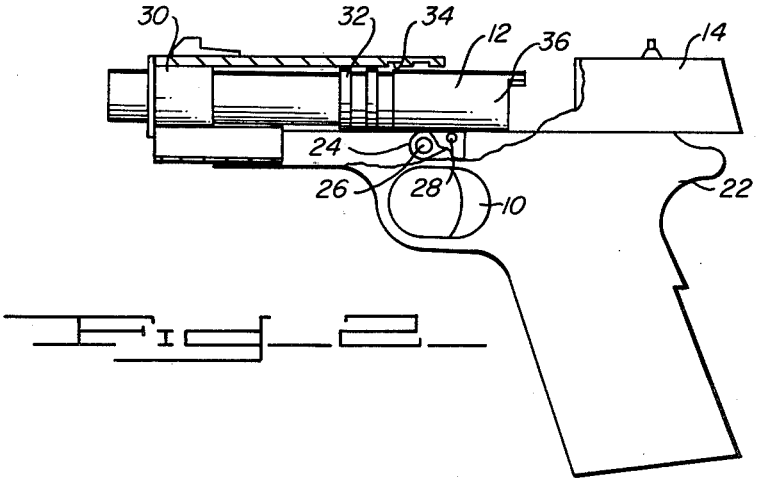
FIG. 2 is a similar view of the pistol after firing to show the degree of pivotal movement of the barrel in unlocking the slide for recoil movement.

FIG. 2 shows the gun after the firing of the cartridge and the slide 14 is in recoil position. The slide 14 moves rearwardly smoothly, accurately and with precision from its in battery position as shown in FIG. 1. Here the impact has driven slide 14 rearwardly, bringing with it the barrel 12 a short distance determined by the link 24 which is shown rotated in a clockwise position from its position in FIG. 1. This rotation has had the effect of moving downwardly the rearward portion 36 of the barrel 12, freeing lugs 32 on the barrel from the grooves 34 on the slot. This then permits slide 14 to retract further rearwardly. Since the barrel 12 has relative longitudinal sliding movement with slide 14 and in addition there is a pivotal movement of the barrel about the barrel bushing 30, there must be of necessity a clearance between the barrel bushing 30 and the barrel 12.

Figure 3:
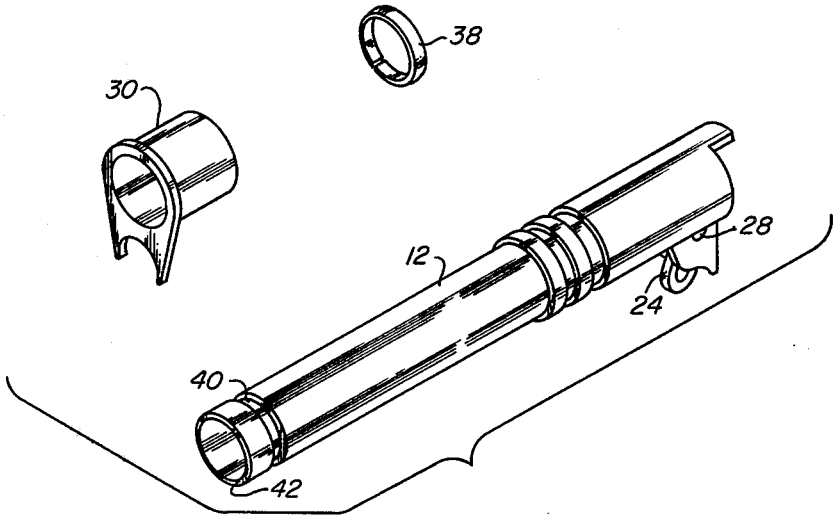
FIG. 3 is an exploded view of the barrel, barrel bushing and snap ring of the present invention.

Reference is now made to FIG. 3 which shows in exploded perspective the barrel bushing 30, barrel 12, and snap ring bearing 38 comprising the present invention. Barrel 12 has a groove 40 approximately 0.025" (twenty-five thousandths of an inch) deep about its outer surface and positioned approximately 3/16 of an inch from the muzzle end 42. The snap ring bearing is split and is approximately 0.032" (thirty-two thousandths of an inch) thick with a rounded outside shoulder. This snap ring bearing is adapted to fit into groove 40 of barrel 12 and fits snugly in the barrel bushing 30 when the slide 14 is in battery position. An enlarged sectional view of this relationship is shown in FIG. 4.

Figure 4:
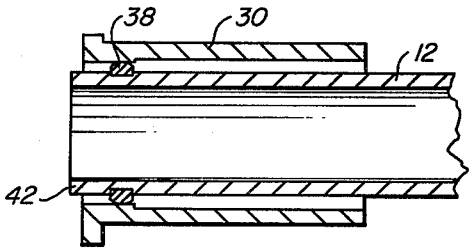
FIG. 4 is a sectional view showing the parts in assembled condition.

It can be seen that the bearing 38 in FIG. 4 serves as a fulcrum for pivotal movement of barrel 12 as it locks and unlocks slide 14 in the operation of the pistol. It also provides the necessary support for the muzzle end 42 with the barrel bushing 30 to eliminate any play between the muzzle end 42 and the slide 14.

It should be noted that when the pistol is in the recoil position as shown in FIG. 2 that this snap ring bearing 38 and the muzzle end of the barrel 12 extends outwardly from the barrel bushing 30, exposing the snap ring bearing 38 to possible damage or even accidental removal. However, in extensive testing this has not occurred. Should such an event occur, the pistol's aiming accuracy is no worse than before and such loss does not affect the operability of the pistol. As it becomes necessary to replace the ring bearing, a ring of greater diameter or thickness may be substituted to compensate for wear on the inside surface of the barrel bushing.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. In combination:

a pistol frame, a slide slidably mounted on said frame between a forward battery position and a rearward recoil position, a barrel bushing on the forward portion of said slide, a barrel having its forward muzzle end slidably and pivotally positioned in said barrel bushing, and a bearing on said barrel engageable with said bushing when said slide is in said forward battery position, said barrel having a groove near the muzzle end thereof with said bearing positioned therein, said bearing consisting of a split ring having a rounded outer shoulder.

2. The combination as in claim 1 wherein said bearing is forward of said bushing when said slide is in rearward recoil position.

3. The combination as set forth in claim 1 wherein said ring is a spring steel snap ring.

4. The combination as in claim 1 wherein said bushing has a tolerance fit with said barrel to permit longitudinal and pivotal movement therein.

5. In combination:

a pistol frame having a slide with front and rear sights thereon, said slide being slidably mounted on said pistol frame, a barrel having lugs near the rear thereof engageable with grooves on said slide whereby engagement therewith provides rearward movement of said barrel with said slide, a link pivotally connecting the rear end of said barrel to said pistol frame to permit rearward and downward movement thereof, a barrel bushing at the front end of said slide receiving the front end of said muzzle therein, said barrel bushing having an opening therein sufficiently large to permit said barrel to move longitudinally and also to pivot thereabout within the limit permitted by said link, and a ring bearing on said barrel engageable with said bushing when said slide is forwardly positioned on said pistol frame, said bearing comprising a split ring having a rounded outer shoulder engageable with said bushing.

* * * * *